US007072595B2

(12) United States Patent
Joichi et al.

(10) Patent No.: US 7,072,595 B2
(45) Date of Patent: Jul. 4, 2006

(54) CONTROLLER FOR CONTROLLING THE CURRENT SUPPLIED TO A MOTOR OF AN IMAGE FORMING APPARATUS

(75) Inventors: Norio Joichi, Tokyo (JP); Atsushi Takahashi, Tokyo (JP); Kazumichi Yamauchi, Tokyo (JP); Yoshihito Sasamoto, Tokyo (JP); Akifumi Isobe, Tokyo (JP); Yoshiki Katayama, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/314,531

(22) Filed: Dec. 9, 2002

(65) Prior Publication Data

US 2003/0118360 A1 Jun. 26, 2003

(30) Foreign Application Priority Data

Dec. 20, 2001 (JP) ..... 2001-387454

(51) Int. Cl.
*G03G 15/00* (2006.01)

(52) U.S. Cl. ..... 399/45; 399/81; 399/361

(58) Field of Classification Search ..... 399/45, 399/36, 361, 381, 389, 81
See application file for complete search history.

(56) References Cited

U.S. PATENT DOCUMENTS 4,610,446 A * 9/1986 Ide
5,715,497 A * 2/1998 Ueda et al.
6,082,724 A * 7/2000 Kahlig et al.
6,263,186 B1 * 7/2001 Okamoto et al.
6,650,436 B1 * 11/2003 Hamamoto et al. ..... 399/389
2001/0035730 A1 * 11/2001 Yoshikawa et al.

FOREIGN PATENT DOCUMENTS

| | | | |
|---|---|---|---|
| JP | 03102053 A | * | 4/1991 |
| JP | 03-227672 A | | 10/1991 |
| JP | 04208952 A | * | 7/1992 |
| JP | 08188286 A | * | 7/1996 |
| JP | 09319170 A | * | 12/1997 |
| JP | 11084788 A | * | 3/1999 |
| JP | 11-130291 A | | 5/1999 |
| JP | 11349160 A | * | 12/1999 |
| JP | 2000108431 A | * | 4/2000 |
| JP | 2000203729 A | * | 7/2000 |
| JP | 2001322734 | * | 11/2001 |
| JP | 2002211786 A | * | 7/2002 |

* cited by examiner

*Primary Examiner*—Susan Lee
(74) *Attorney, Agent, or Firm*—Frishauf, Holtz, Goodman & Chick, P.C.

(57) ABSTRACT

An image forming apparatus has a sheet feeding section for conveying a sheet for image formation, a stepping motor for driving the sheet feeding section, and a controller for controlling operation of the stepping motor. The controller includes a current value setting section. The current value setting section sets a current value that actuates the stepping motor based on sheet information obtained through at least one section selected from a thickness detecting section, size detecting section, and paper quality detecting section. The thickness detecting section detects a thickness of the sheet. The size detecting section detects a size of the sheet. The paper quality detecting section detects a paper quality of the sheet.

14 Claims, 3 Drawing Sheets

CONTROLLER FOR CONTROLLING THE CURRENT SUPPLIED TO A MOTOR OF AN IMAGE FORMING APPARATUS

BACKGROUND OF THE INVENTION

1. Field of the Invention

The present invention relates to an image forming apparatus, e.g., a copying machine or printer, having a driving source for driving a sheet convey means which conveys a sheet and, more particularly, to an image forming apparatus in which a current value preset based on various kinds of sheet information and/or an image formation mode is supplied to the driving source of a sheet convey means.

2. Description of the Related Art

In an image forming apparatus, a sheet is fed out from a sheet feed tray in accordance with the image forming process. The sheet is fed again by registration rollers arranged close to an image carrier so as to be superimposed on a toner image forming on the image carrier. The toner image is transferred at a transfer region. After the toner image is fixed on the sheet by a fixing unit, the sheet is delivered outside the apparatus. Alternatively, after the toner image is fixed by the fixing unit, the sheet is reversed, and is fed out to the transfer region again so that another toner image is fixed on its second side. After the second toner image is fixed by the fixing unit, the sheet is delivered outside the apparatus.

The image forming apparatus as described above has a convey means comprised of a large number of convey roller pairs along the sheet convey path. Hence, conventionally, the convey path is appropriately divided to form a plurality of convey systems. Exclusive motors are provided for the divisional convey systems, respectively. Each motor is rotated or stopped by drive control through a controller.

Regarding the drive control of the motor, for example, the motor is controlled with a specific current pattern. Then, when the motor is to be started or reversed (rotated in the opposite direction to the forward rotation of the motor) where a large load torque is required, it is driven by a high current value. When the motor is to rotate in a steady rotation state, it is driven by a low current value. Alternatively, the motor is driven by a fixed high current value. Either method is employed.

In drive control of the motor in the image forming apparatus or the like, however, a high current value based on conditions with which the load torque increases is continuously supplied to the motor not only in starting or reversing it, but also in the steady rotation state, so that sheets having different paper qualities and sizes can be conveyed reliably. Even when a sheet which requires a small load torque and accordingly with which a low current value may suffice is to be used, an excessively high current is continuously supplied. This leads to unwanted temperature increase of the motor or a driving circuit and causes a power loss.

SUMMARY OF THE INVENTION

The present invention has been made in view of the above problems of the conventional related art, and has as its object to provide an image forming apparatus having a current value setting means which is improved so as to supply a current value preset based on information on various types of sheets to be used to the driving source of a sheet convey means, so that unwanted heat generation and power loss are minimized as much as possible.

In order to achieve the above object, according to the first main aspect of the present invention, there is provided an image forming apparatus having sheet convey means for conveying a sheet for image formation, a driving source for driving the sheet convey means, and a controller for controlling operation of the driving source, wherein the controller comprises current value setting means which sets a current value that actuates the driving source based on sheet information obtained through at least one means selected from thickness detecting means for detecting a thickness of the sheet, size detecting means for detecting a size of the sheet, and paper quality detecting means for detecting a paper quality of the sheet.

In order to achieve the above object, according to the second main aspect of the present invention, there is provided an image forming apparatus having sheet convey means for conveying a sheet for image formation, a driving source for driving the sheet convey means, and a controller for controlling operation of the driving source, wherein the controller comprises current value setting means which sets a current value that actuates the driving source based on an image formation mode and sheet information which is obtained through at least one means selected from thickness detecting means for detecting a thickness of the sheet, size detecting means for detecting a size of the sheet, and paper quality detecting means for detecting a paper quality of the sheet.

The image forming apparatus according to the first and/or second main aspect has the following subsidiary aspects.

The driving source is a stepping motor.

The sheet convey means comprises a plurality of convey systems and a plurality of driving sources respectively corresponding to the plurality of convey systems.

The current value is set by appropriately selecting a plurality of current values stored in a table created in advance.

The image formation mode is one image mode selected from single-sided copy mode, double-sided copy mode, and reversal delivery mode.

When the current is defined as I, I is set to a current value obtained from an equation $\{I=\alpha\cdot f(a)+\beta\cdot g(b)+\gamma\cdot h(c)+\delta\cdot j(d)+\epsilon\}$ (where $\alpha$, $\beta$, $\gamma$, $\delta$, and $\epsilon$ are constants, f(a) is a function having a sheet thickness as a variable and indicating a load torque, g(b) is a function having a sheet size as a variable and indicating a load torque, h(c) is a function having a paper quality as a variable and indicating a load torque, and j(d) is a function having an image formation mode as a variable and indicating a load torque).

As will be understood from the above aspects, according to the present invention, the current value for the driving source of the sheet convey system can be controlled based on the sheet information such as the paper thickness, size, and paper quality, and/or the image formation mode. Therefore, an image forming apparatus, in which more appropriate control operation concerning sheet conveyance is enabled, and unwanted heat generation by a motor and the like and power loss are reduced, can be provided.

The above and many other objects, features and advantages of the present invention will become manifest to-those skilled in the art upon making reference to the following detailed description and accompanying drawings in which a preferred embodiment incorporating the principle of the present invention is shown by way of an illustrative example.

DETAILED DESCRIPTION OF THE PREFERRED EMBODIMENT

A preferred embodiment of the present invention will be described with reference to the accompanying drawings.

Figure 1:
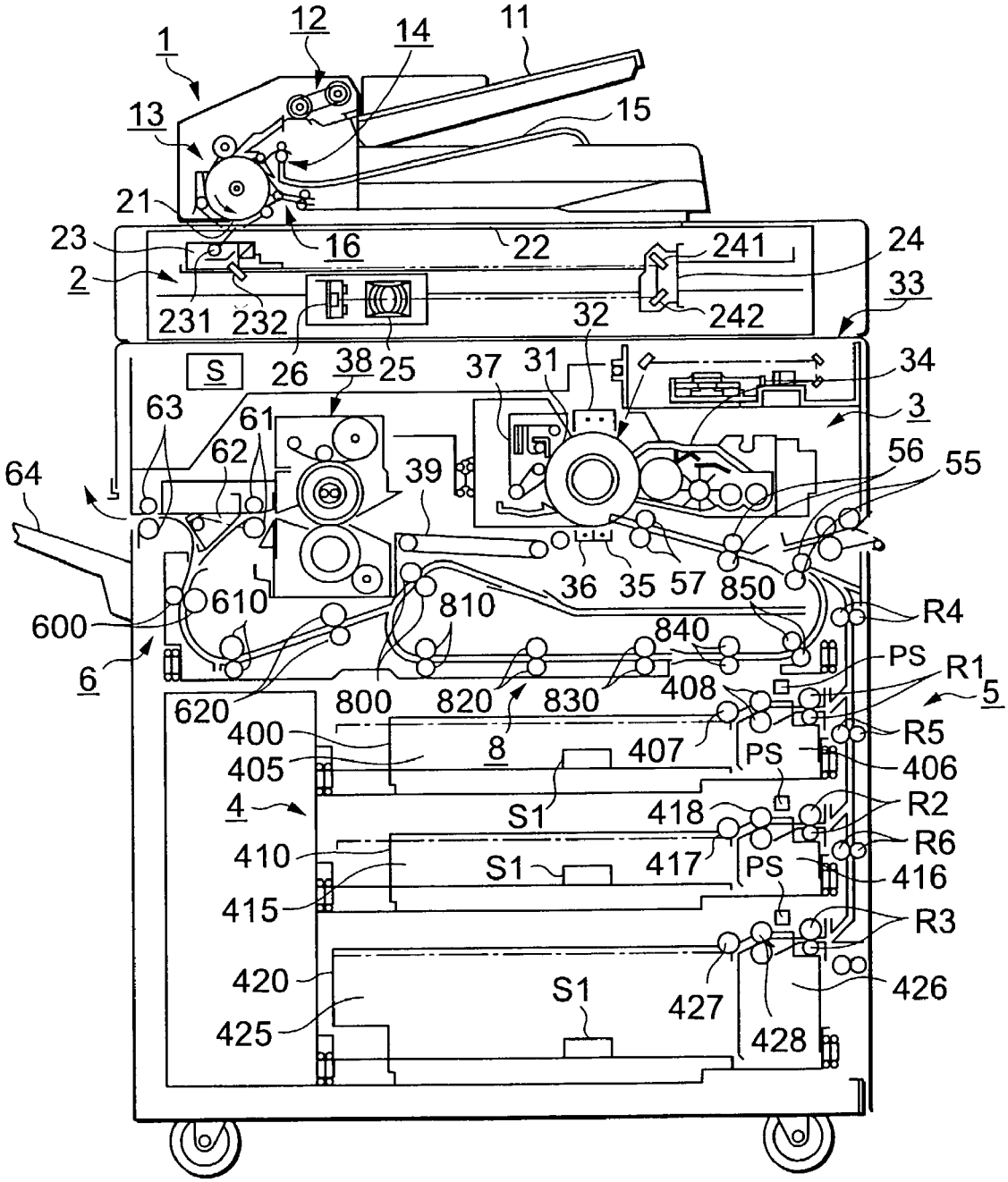
FIG. 1 is a schematic view showing the schematic overall arrangement of an image forming apparatus of the present invention.
Figure 2:
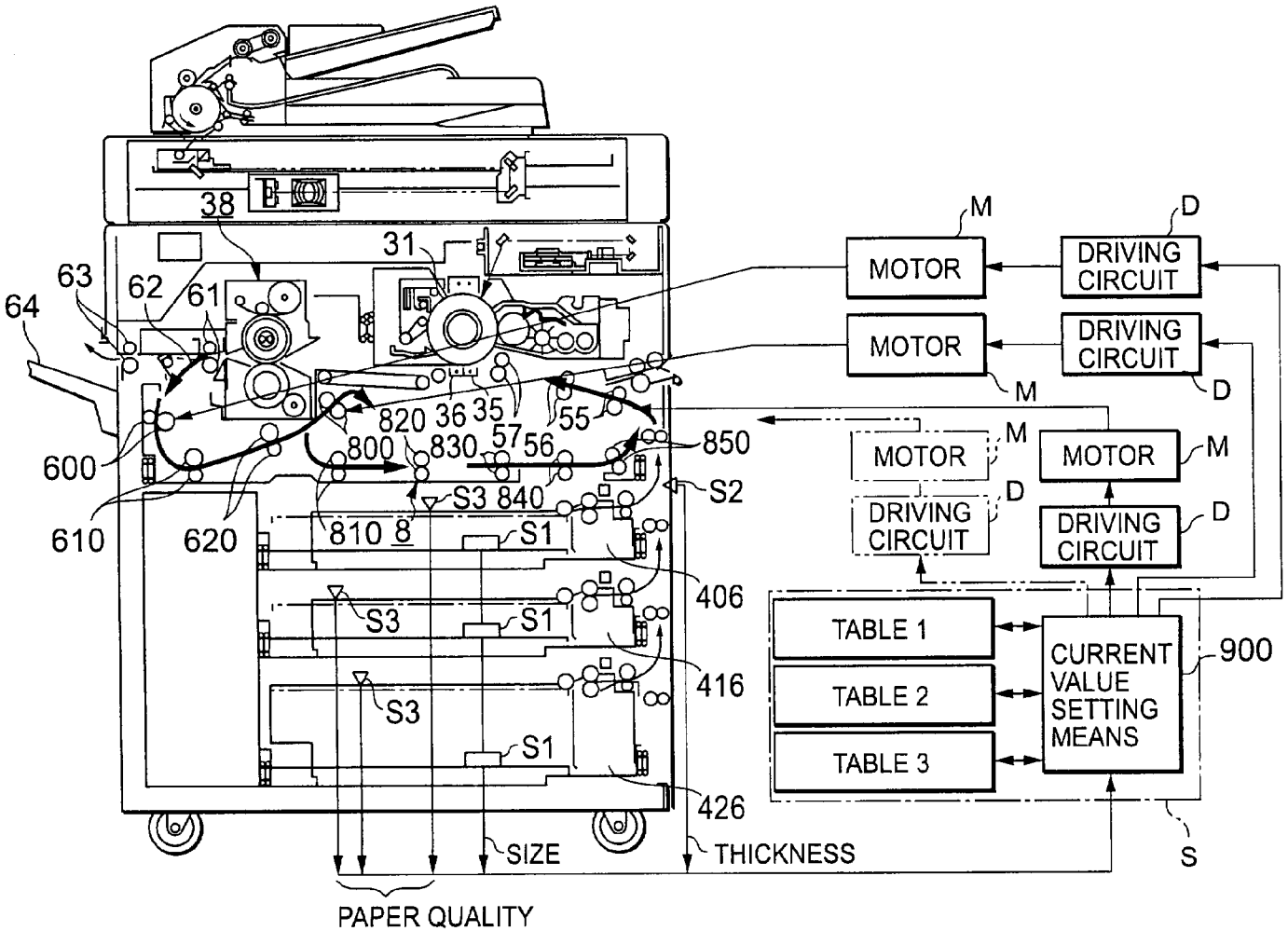
FIG. 2 is a schematic view showing a sheet circulating convey path and control system in the image forming apparatus of-the present invention.

As apparent from FIGS. 1 and 2, an image forming apparatus of the present invention has an automatic document feeder 1, image reading unit 2, image forming section 3, sheet storing section 4, sheet feeding section 5, reversal delivery/re-feeding section 6, and reversal convey section 8.

The automatic document feeder 1 feeds out document sheets one by one to convey each sheet to an image reading position, and delivers the sheet after image reading to a predetermined position.

The automatic document feeder 1 has a document table 11 on which a document is to be placed, a document separating means 12 for separating the document sheets placed on the document table 11, a document conveying means 13 including a plurality of rollers which convey the document sheet separated by the document separating means 12, a document delivery means 14 for delivering the document sheet conveyed by the document conveying means 13, a document delivery table 15 on which the document sheet delivered by the document delivery means 14 is to be placed, and a document reversing means 16 comprised of a reversing roller pair for turning over the document sheet when images on the two sides of the document sheet are to be read.

A plurality of document sheets (not shown) placed on the document table 11 are separated one by one by the document separating means 12, and are conveyed by the document conveying means 13 toward an image reading position.

The document reading position is located below the document conveying means 13. At this position, the image of the document sheet is read through a slit 21 of the image reading unit 2.

The document sheet from which the image has been read is delivered onto the document delivery table 15 by the document delivery means 14.

When reading images on the two sides of the document sheet, the document sheet from which the image on one side has been read is guided to the document reversing means 16. When the trailing end of the document sheet is clamped by the reversing roller pair constituting the document reversing means 16, the reversing roller pair is rotated in the reverse direction to turn over the document sheet. Then, the document sheet is conveyed by the document conveying means 13 again. Thus, the image on the other side (second side) can be read at the document reading position.

This process is repeated a number of times corresponding to the number of the plurality of document sheets placed on the document table 11.

The automatic document feeder 1 can be fallen down. When the automatic document feeder 1 is raised upright to open up the space above a platen glass plate 22, a document sheet can be placed directly on the platen glass plate 22 and be copied.

The image reading unit 2 serves to read the image of the document sheet to obtain image data. The image reading unit 2 has a first mirror unit 23 formed by integrating a lamp 231 for irradiating the document sheet through the slit 21 and a first mirror 232 for reflecting light from the document sheet, a second mirror unit 24 formed by integrating a second mirror 241 for reflecting light from the first mirror 232 and a third mirror 242, an image forming lens 25 for causing the light reflected by the second mirror unit 24 to form an image on a CCD 26 as an image sensing element (to be described later), and a linear CCD 26 for obtaining image data by photoelectrically converting the optical image formed by the image forming lens 25.

The image data is subjected to an appropriate image process, and is then accumulated once in a memory (not shown).

When the document sheet which is being fed by the automatic document feeder 1 is to be read by the image reading unit 2, the first and second mirror units 23 and 24 are fixed at positions shown in FIG. 1.

When the image of the document sheet directly placed on the platen glass plate 22 is to be read, the image is read by moving the first and second mirror units 23 and 24 along the platen glass plate 22 while maintaining their optical path lengths.

The image forming section 3 forms an image by using an electrophotographic process. The image forming section 3 has a photosensitive drum 31 having a photoconductive photosensitive layer serving as an image carrier on its surface, a charging unit 32 for uniformly charging the surface of the photosensitive drum 31, a laser write system 33 serving as an exposure means which is operated based on the image data after image processing and exposes the photosensitive drum 31 to form an electrostatic latent image, a developing unit 34 for reversely developing the electrostatic charge latent image formed on the photosensitive drum 31 to form a toner image, a transfer electrode 35 for transferring the toner image onto a sheet, a discharging unit 36 for discharging the sheet, on which the toner image has been transferred, by performing AC corona discharge from above the photosensitive drum 31, thus promoting separation of the sheet, a cleaning means 37 for cleaning the photosensitive drum 31 after the transfer step, and the like.

Reference numeral 38 denotes a heat roller type fixing unit; 39, a convey belt for conveying the separated sheet toward the fixing unit 38; 61, fixing delivery rollers, and 63, delivery rollers. These components are arranged on substantially the same horizontal line as the discharging unit 36.

To achieve image formation with the above arrangement, the photosensitive drum 31 which rotates by an appropriate driving means in a direction indicated by an arrow is sequentially charged by the charging unit 32. After that, the laser write system 33 performs dot exposure to form an electrostatic latent image on the photosensitive drum 31. The developing unit 34 develops the electrostatic charge latent image into a toner image. Then, the toner image is transferred onto a sheet which is fed when registration rollers 56, serving as the second sheet feed means, start rotation, through the operation of the transfer electrode 35.

Actually, after the sheet arrives at the registration rollers 56, a process of forming the toner image on the photosensitive drum 31 is started synchronously when the sheet is fed upon start of rotation of the registration rollers 56.

For this purpose, the distance from the exposure portion to the transfer electrode 35 and that from the registration rollers 56 to the transfer electrode 35 are set equal so that the toner image and the sheet overlap at the transfer region where the transfer electrode 35 exists. Also, the linear velocities of the photosensitive drum 31, the registration rollers 56, and pre-transfer rollers 57 are set equal.

The transferred sheet is separated from the photosensitive drum 31 by the operation of the discharging unit 36, is heated and pressed by the fixing unit 38, and is discharged outside the apparatus.

The photosensitive drum 31 that has passed through the transfer region further continues rotation. The residual toner on the photosensitive drum 31 is accordingly removed by the cleaning means 37, to prepare for next image formation.

In the sheet storing section 4, sheet feed trays 400, 410, and 420, in which storage containers 405, 415, and 425 for storing sheets in a stacked state and sheet feed units 406, 416, and 426 serving as the first sheet feed means are integrally formed, are arranged in the vertical direction. The sheet feed units 406, 416, and 426 respectively have sheet feed rollers 407, 417, and 427 and double-feed preventive separation rollers 408, 418, and 428.

The respective sheet feed trays store sheets with different sizes.

For example, the sheet feed tray 400 stores letter-size sheets. The sheet feed tray 410 stores A4-size sheets. The sheet feed tray 420 stores legal-size sheets. The sheets of any size are to be fed by shorter-sided feeding (their shorter sides extend along the convey direction).

The sheet feed trays respectively have regulation plates which can move in directions perpendicular to each other and which regulate the side and trailing edges of sheets that can be fixed in position.

The arrangement of the regulation plates (not shown) can use the known technique. The size of the sheet is detected by a size detecting means S1 from the position of the regulation plate. This information is loaded by a current value setting means 900 (see FIG. 2) in a controller S, more particularly, in a program flow formed of a predetermined closed loop, and is displayed by the liquid crystal display of an operating portion formed on the upper surface of the apparatus.

In this embodiment, a thickness detecting means S2 and paper quality detecting means S3 for respectively detecting the thickness and paper quality of the sheet are formed at positions shown in FIG. 2.

The thickness detecting means S2 is formed midway along a convey path common to the sheets fed from the respective sheet feed trays. The paper quality detecting means S3 are formed on the respective sheet feed trays.

Sheet information on the thickness and paper quality of the sheets are loaded by the controller S, and is displayed by the liquid crystal display of the operating portion, in the same manner as the information from the size detecting means S1.

As the thickness detecting means S2, a sensor using a resistance, electrostatic capacitance, ultrasonic wave, or laser beam can be used As the paper quality detecting means S3, a sensor utilizing a difference in reflectance on the sheet surface can be used The pieces of information concerning the sheets, e.g., size information, thickness information, or paper quality information, which are loaded by the controller S are used as factors for setting, with the current value setting means 900, a current value to be supplied to a corresponding motor M as a driving source for the sheet convey means, as shown in FIG. 2.

FIG. 2 schematically shows the arrangement of motor control and a sheet circulating convey path (to be described later), and will be described later in detail.

The sheets to be stored in the sheet feed trays are not limited to plain paper but can be regenerated paper, coat paper, OHP film sheets, and the like.

The liquid crystal display of the operating portion can be fabricated as a hierarchical touch panel.

More specifically, in the operating portion, display portions for the paper thickness, paper size, and paper quality may be partitioned, so they can be used as the setting means (setting keys) for setting conditions such as the paper thickness, paper size, and paper quality.

If the current value setting means 900 loads a signal generated upon operation of this setting means 900, it can fill its role together with the detecting means S1, S2, and S3 described above.

The sheet feeding section 5 has convey roller pairs (to be also referred to as convey rollers hereinafter) R1, R2, R3, R4, R5, and R6 as convey means for conveying the sheets from the respective sheet feed trays to the image forming section 3.

The convey roller pairs R1 to R3 are preferably formed as pre-registration rollers integrally with the sheet feed units 406, 416, and 426, and are integrally formed in this embodiment.

Reference symbols PS denote photosensors. For example, one photosensor PS has a function of detecting whether a sheet fed from the sheet feed tray 400 by the sheet feed roller 407 has reached the convey roller pair R1 formed downstream of the separation rollers 408. This photosensor PS is arranged at a position immediately before the convey roller pair R1.

Reference numeral 55 denotes convey rollers provided downstream of the convey roller pair R4. The convey rollers 55 are formed at a convey path merge portion for a sheet fed out through the reversal convey section 8 and a sheet fed from, e.g., the sheet feed tray 400.

Reference numeral 56 denotes registration rollers as the second sheet feed means; and 57, the pre-transfer rollers.

The reversal delivery/re-feeding section 6 is a region where a transferred and fixed sheet is reversely delivered or the sheet is fed again in accordance with the double-sided image formation mode. The reversal delivery/re-feeding section 6 has a switching means 62 which switches convey paths when the sheet delivered by the fixing delivery rollers 61 is to be directly delivered outside the apparatus, when the sheet is to be turned over and then delivered, and when the sheet is to be fed again toward the registration rollers 56 so that an image is formed on the lower side (second side) of the sheet.

When the sheet on which an image has been formed is to be delivered directly, i.e., with its image side facing up, the switching means 62 is held at the position indicated by an alternate long and short dashed line in FIG. 1. When the sheet on which an image has been formed is to be turned over and delivered, the switching means 62 is held at the position indicated by a solid one in FIG. 1. The sheet conveyed by the fixing delivery rollers 61 is fed to a convey path provided with the rollers 600, 610, and 620. The operation of the roller groups are stopped simultaneously when the trailing end of the sheet reaches a position before the convey rollers 600. After that, the convey rollers 600 are rotated in the opposite direction to that described above. As a result, the sheet passes on the left side of the switching means 62 and is delivered to a delivery tray 64 outside of the apparatus.

In the double-sided copy mode for forming an image on the second side of the sheet successively to the first side, the switching means 62 is held at the position indicated by the solid line in FIG. 1. The sheet conveyed by the fixing delivery rollers 61 is fed to the reversal convey section 8 through the respective convey rollers of the reversal delivery/re-feeding section 6 driven by the delivery motor. After the sheet is turned over, it is fed out toward the registration rollers 56, and is processed in accordance with the same process as image formation described above. Then, the sheet is delivered onto the delivery tray 64 in an either manner described above.

As described above, the reversal convey section 8 is a reversal convey means which turns over the sheet and forms part of the sheet circulating convey path (a circulating path extending through the registration rollers 56—fixing unit 38—reversal delivery/re-feeding section 6—reversal convey section 8—registration rollers 56), and has a plurality of roller pairs (to be also merely referred to as convey rollers hereinafter) 800, 810, 820, 830, 840, and 850.

In FIG. 2, the circulating convey path is indicated by thick arrows.

Of the convey rollers, the rollers 800 are driven by the corresponding motor M in both forward and reverse directions, and will be referred to as ADU reversal rollers hereinafter to distinguish them from other rollers.

A sheet where an image is to be formed on its second side behaves particularly in the reversal convey section 8 as follows. The sheet moves along the convey path by the driving operations of the roller groups (600, 610, 620) of the reversal delivery/re-feeding section 6, and continually moves in the same direction by the driving operation of the ADU reversal rollers 800. With the trailing end of the sheet being clamped by the ADU rollers 800, when the ADU reversal rollers 800 stop rotation, the sheet stops moving. After that, the sheet is switched back by the driving force of the ADU reversal rollers 800 rotated in the opposite direction to the rotating direction, and enters the left convey path through the branch point and is turned down. In this state, the sheet moves to the right along the horizontal convey path as it is conveyed by the convey rollers 810 to 850, and then moves upward, to reach the registration rollers 56.

According to this embodiment, in the double-sided copy mode, five sheets can be subjected as one set to continuous image formation.

For example, assume that image formation for ten sheets is instructed through the setting means of the operating portion. After image formation on five sheets of one set is ended, an image formation process for the sixth to tenth sheets is performed.

An arrangement and control concerning a large number of sheet convey means provided to the convey path in the above manner will be briefly explained.

In this embodiment, the sheet convey means is divided into a first convey system comprised of the convey roller groups (R6, R5, R4, and 55) of the sheet feeding section 5, a second convey system including the pre-transfer rollers 57, convey belt 39, and fixing delivery rollers 61, a third convey system comprised of the roller groups (600, 610, and 620) of the reversal delivery/re-feeding section 6, a fourth convey system comprised of the roller groups (810, 820, 830, 840, and 850) constituting the reversal convey section 8, and another convey system which is directly power-coupled to the corresponding motor and controlled alone and which includes the registration rollers 56, fixing unit 38, ADU reversal rollers 800, sheet feed rollers corresponding to the respective sheet feed trays (400, 410, and 420), and the like.

In the convey systems excluding the one which is controlled alone, the convey rollers 55, pre-transfer rollers 57, convey rollers 600, and convey rollers 810 are connected to the corresponding motors so that they serve as driving rollers. Rotational powers from the motors are transmitted to other rollers of the respective convey systems through appropriate power transmitting means, e.g., a clutch, toothed belt, or gear train.

In this embodiment, the convey speed (linear velocity) of the first convey system is set relatively high, that of the second convey system is set relatively low, and those of the third and fourth convey systems are set relatively high.

The convey speeds and circulating convey path length are determined such that the registration rollers 56 can be controlled to operate at a constant time interval not only when images are to be continuously formed on one side of a plurality of sheets but also when images are to be continuously formed on the two sides of a plurality of sheets, and that efficient image formation per unit time is enabled for the sheets with the three types of sizes described above.

As a means for operating the registration rollers 56 at the constant interval, in the case of double-sided image formation, the convey speed of the fourth convey system in the reversal convey section 8 is changed in accordance with the sheet size. For example, when A4-size sheets with a length in the convey direction which is smaller than that of reference-size (letter-size) sheets are selected, the convey speed in the reversal convey section 8 is set low. Inversely, when legal-size sheets with a length in the convey direction which is larger than that of the reference-size sheets, are selected, the sheet convey speed in the reversal convey section 8 is set low.

In the image forming apparatus according to this embodiment, the image formation mode until sheet delivery includes single-sided copy mode of forming an image on one side of the sheet, double-sided copy mode of forming images on the two sides of the sheet, and reversal delivery mode of reversing the sheet and then delivering the sheet. As the sheet feed paths and convey speeds are different, the load acting on the convey system changes for each image formation mode.

When factors such as the sheet size, sheet thickness, and paper quality are added to the image formation mode described above, the fluctuation range of the load against the convey system widens.

For example, the larger the sheet thickness, the larger the load acting on the convey system. The larger the sheet size, the larger the friction during conveyance, and accordingly the larger the load acting on the convey system. Furthermore, regarding the paper quality of the sheet, the more coarse the surface is and the larger the friction is, the larger the load acting on the convey system.

A sheet with high adhesion properties, e.g., OHP film sheets and coat paper (which will be referred to as special paper hereinafter), also increases the load.

Fluctuations in load acting on the convey system, and above all those in load acting on the motor, may sometimes make it difficult to feed a sheet at a predetermined convey speed.

In order to solve these inconveniences, in this embodiment, the sheet information such as the sheet size is loaded by the controller S, as will be understood from FIG. 2. The current value to be supplied to each motor M is set by the current value setting means 900, and a current with the preset value is supplied to the motor M through the driving circuit D.

More specifically, employing the sheet information (size, thickness, and paper quality) and image formation mode (single-sided copy mode, double-sided copy mode, and reversal delivery mode) as parameters, the following equation (1), a current preset table created by utilizing equation (1), or an empirically obtained current preset table is stored in the memory of the controller S. Equation (1) is obtained by arithmetic operation. Alternatively, the preset current value which is set by the current value setting means 900 through selection from the current preset table is supplied to the motor M. Therefore, the load to the motor M is eliminated, and the sheet can be conveyed at the predetermined convey speed.

$$I=\alpha\cdot f(a)+\beta\cdot g(b)+\gamma\cdot h(c)+\delta\cdot j(d)+\epsilon \quad (1)$$

where α, β, γ, δ, and ϵ constants, f(a): a function having a sheet thickness as a variable and indicating a load torque, g(b): a function having a sheet size as a variable and indicating a load torque, h(c): a function having a paper quality as a variable and indicating a load torque, and j(d): a function having an image formation mode as a variable and indicating a load torque Each function, e.g., f(a), can be obtained from the following equation (2):

$$f(a)=m\cdot a+n \quad (2)$$

where m and n are constants and a is a sheet thickness.

According to the present inventor, the current value can be set only by the above parameters, particularly by the sheet information. Even when the current value is uniquely set by using one information among the sheet information, e.g., either one of the size, thickness, and paper quality, the sheet can be conveyed within a range not hindering image formation. Also, a decrease in unwanted temperature rise of the motor driving circuit can be expected.

When the current value is to be set by utilizing one type of sheet information, the information priority differs depending on the arrangement and specification of the apparatus, and will accordingly be determined when needed.

In this case, when the respective functions such as f(a), g(b), h(c), j(d), and the like are represented by, e.g., f(a), it suffices if a table indicating thick (0.5), intermediate (0.4), and thin (0.3) is prepared.

Naturally, the function can be set by two or three elements, e.g., by using the sheet thickness and paper quality as the parameters.

The following Table 1 shows an example of a table which is used when the current value to be supplied to the motor M is to be selectively set by using the sheet thickness and paper quality (surface roughness) as the parameters.

TABLE 1

| Paper Quality (Surface Roughness) | Sheet Thickness | | |
|---|---|---|---|
| | Thick | Intermediate | Thin |
| Coarse | I1 | I2 | I3 |
| Intermediate | I2 | I3 | I4 |
| Dense | I3 | I4 | I5 |

In the table, the current value I has a relationship of I1>I2>I3>I4>I5.

As the motor M, a stepping motor is suitable.

The motor can be either of a hybrid or permanent magnet type.

As a method of changing the current, constant current control by means of chopping is generally employed. A method of changing a voltage to be applied may alternatively be employed.

Regarding the paper quality, for example, it has been described in Table 1 by classification with three classes, i.e., coarse, intermediate, and dense, but the present invention is not limited to this. For example, classification may be made with plain paper having a basis weight of 20 g/cm$^2$ to 300 g/cm$^2$, and special paper such as OHP film sheets or surface coat paper.

Figure 3:
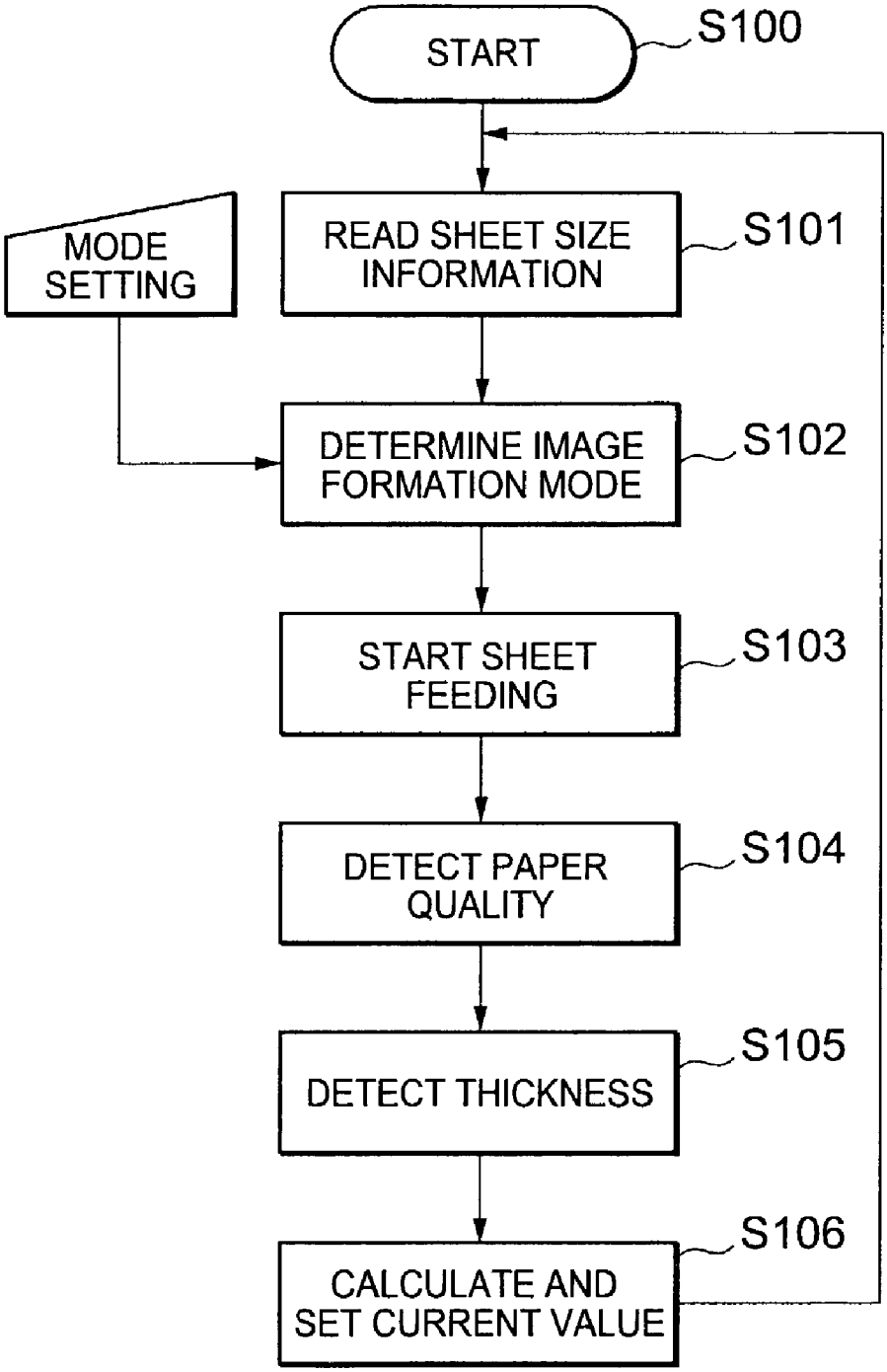
FIG. 3 is a closed loop program flow chart concerning how to set a current value for a driving source.

FIG. 3 shows the closed loop of a program flow concerning current value setting by the current value setting means 900 in the controller S.

Referring to FIG. 3, the program is started (S100) and the size information of the sheet to be used is read (S101). After that, information on mode setting is fetched to determine the image formation mode (S102). Then, feeding of the sheet in the sheet feed tray (described above) is started (S103).

After that, the paper quality is detected in step S104, the sheet thickness is detected in S105, the current value to be supplied to the motor is set (S106), and the loop is closed. This operation is repeated when needed.

What is claimed is:

1. An image forming apparatus comprising:

at least one sheet convey system for conveying a sheet for image formation, at least one stepping motor for driving the sheet convey system, and a controller for controlling operation of the stepping motor, wherein the controller comprises a current value setting unit which sets a current value that actuates the stepping motor based on sheet information obtained through (i) a thickness detecting unit for detecting a thickness of the sheet, (ii) a size detecting unit for detecting a size of the sheet, and (iii) a paper quality detecting unit for detecting a paper quality of the sheet.

2. An apparatus according to claim 1, wherein the at least one sheet convey system comprises a plurality of convey systems and the at least one stepping motor comprises a plurality of stepping motors respectively corresponding to the plurality of convey systems.

3. An apparatus according to claim 1, wherein the current value is set by appropriately selecting a plurality of current values stored in a table which is created in advance.

4. An apparatus according to claim 1, wherein the current value is changed by constant current control by chopping.

5. An apparatus according to claim 1, wherein the current value is changed by changing a voltage to be applied.

6. An image forming apparatus comprising:

at least one sheet convey system for conveying a sheet for image formation, at least one stepping motor for driving the sheet convey system, and a controller for controlling operation of the stepping motor, wherein the controller comprises a current value setting unit which sets a current value that actuates the stepping motor based on (i) an image formation mode, and (ii) first sheet information which is obtained through a paper quality detecting unit for detecting a paper quality of the sheets and (iii) second sheet information which is obtained through at least one of a thickness detecting unit for detecting a thickness of the sheet, and a size detecting unit for detecting a size of the sheet.

7. An apparatus according to claim 6, wherein the at least one sheet convey system comprises a plurality of convey systems and the at least one stepping motor comprises a plurality of stepping motors respectively corresponding to the plurality of convey systems.

8. An apparatus according to claim 6, wherein the current value is set by appropriately selecting a plurality of current values stored in a table which is created in advance.

9. An apparatus according to claim 6, wherein the current value is changed by constant current control by chopping.

10. An apparatus according to claim 6, wherein the current value is changed by changing a voltage to be applied.

11. An apparatus according to claim 6, wherein the image formation mode comprises one of a single sided copy mode, a double sided copy mode, and a reversal delivery mode.

12. An apparatus according to claim 6, wherein the current value is defined as I, as follows:

$$I=\alpha\cdot f(a)+\beta\cdot g(b)+\gamma\cdot h(c)+\delta\cdot j(d)+e$$

where:

$\alpha$, $\beta$, $\gamma$, $\delta$, and e are constants, f(a) is a function having the sheet thickness as a variable and indicating a load torque, g(b) is a function having the sheet size as a variable and indicating a load torque, h(c) is a function having the paper quality as a variable and indicating a load torque, and j(d) is a function having the image formation mode as a variable and indicating a load torque.

13. An image forming apparatus comprising:

a sheet convey system for conveying a sheet for image formation;

a stepping motor for driving the sheet convey system; and a controller for controlling operation of the stepping motor;

wherein the controller comprises a current value setting unit which sets a current value that actuates the stepping motor based on sheet information obtained through (i) a thickness setting unit for setting a thickness of the sheet, (ii) a size setting unit for setting a size of the sheet, and (iii) a paper quality setting unit for setting a paper quality of the sheet.

14. An image forming apparatus comprising:

a sheet convey system for conveying a sheet for image formation;

a stepping motor for driving the sheet convey system; and a controller for controlling operation of the stepping motor;

wherein the controller comprises a current value setting unit which sets a current value that actuates the stepping motor based on (i) an image formation mode, (ii) first sheet information which is obtained through a paper quality setting unit for setting a paper quality of the sheet, and (iii) second sheet information which is obtained through at least one of a thickness setting unit for setting a thickness of the sheet, and a size setting unit for setting a size of the sheet.

* * * * *